US008230650B1

(12) United States Patent
Stamps

(10) Patent No.: US 8,230,650 B1
(45) Date of Patent: Jul. 31, 2012

(54) SHAPE-MEMORY SPRING ACTIVATED SOFFIT OR FOUNDATION VENT

(76) Inventor: Forrest Stamps, Danville, CA (US)

( * ) Notice: Subject to any disclaimer, the term of this patent is extended or adjusted under 35 U.S.C. 154(b) by 770 days.

(21) Appl. No.: 12/283,860

(22) Filed: Sep. 15, 2008

(51) Int. Cl.
*E04B 7/00* (2006.01)

(52) U.S. Cl. ..... 52/198; 52/95

(58) Field of Classification Search ..... 52/95, 198, 52/199; 454/260, 257, 258, 264, 265, 266, 454/358, 360, 363, 364, 365, 366, 369
See application file for complete search history.

(56) References Cited

U.S. PATENT DOCUMENTS 2,718,187 A * 9/1955 Frisby ..... 454/260
4,497,241 A * 2/1985 Ohkata ..... 454/258
4,541,326 A * 9/1985 Fukuda et al. ..... 454/258
4,597,324 A * 7/1986 Spilde ..... 454/364
4,667,581 A * 5/1987 Hovland ..... 454/260
4,715,268 A * 12/1987 Tanner ..... 454/256
4,848,653 A * 7/1989 Van Becelaere ..... 236/49.3
5,393,221 A * 2/1995 McNally ..... 122/14.1
2004/0129315 A1 * 7/2004 Dario et al. ..... 137/487.5

* cited by examiner

*Primary Examiner* — Jessica Laux
(74) *Attorney, Agent, or Firm* — Risto A. Rinne, Jr.

(57) ABSTRACT

An apparatus for permitting venting through eaves and foundation walls at low temperature and which closes at high temperature includes a shape-memory alloy spring that has a first expanded state at the low temperature and a second contracted state at the high temperature. At high temperature the shape-memory alloy spring contract which, in turn, closes a pivoting louver thereby obstructing the passage of air. At low temperature, after overcoming hysteresis, the shape-memory alloy spring expands and a counterforce type of spring is then able to urge the louver back into the open position. This process can be repeated, if necessary, thereby eliminating the need for replacement of the apparatus after experience of the high temperature event has occurred.

13 Claims, 2 Drawing Sheets

SHAPE-MEMORY SPRING ACTIVATED SOFFIT OR FOUNDATION VENT

BACKGROUND OF THE INVENTION

1. Field of the Invention

The present invention, in general, relates to soffit or foundation vents and, more particularly, to vents that close when a predetermined temperature threshold is exceeded.

Current fire codes allow for soffit types of attic vents or for foundation vents, to include a one-quarter inch mesh. This dimension is intended to keep birds or animals from entering through the vent. Soffit vents are disposed under the eaves of buildings (homes or commercial) and foundation vents are disposed through the concrete foundation walls that support a building structure.

Most homes (and some businesses) that catch on fire from wildfires that approach the structures are ignited by embers that fall either on the roof of the home (or business) or by embers which are able to enter the structure by their passage through an attic soffit vent.

Attic soffit vents allow for the passage of air and are useful in cooling the attic area during hot days or when the roof is exposed to direct sun. As such, together with warmed air they facilitate the creation of a draft. While the draft is normally desirable, during a nearby fire, the draft can permit embers to pass through the vent and ignite the structure somewhere in the attic area.

Even more troublesome, during a fire temperature differentials are apt to become excessive as ambient air is heated by the flames and this will create exceptionally powerful drafts that can convey embers through the mesh and into the attic with great force. As a result, even larger embers or other similarly sized objects that might not normally be able to pass through the mesh during a more standard amount of draft are able to enter during the increased draft produced by a fire. The strong draft is able to break apart larger embers that come in contact with the mesh and draw them into the attic space.

It is important to note that when there is the greatest amount of danger to the structure, such as during a nearby fire, the very nature of the vent which is to utilize and create draft is also increased at that time, and this capability is contrary to the needs of a homeowner because it aggravates what is already a potentially dangerous situation.

Additionally, when the structure is ignited from a location in the attic it is especially difficult, if not impossible, for firefighters to apply water to it until the entire structure has been engulfed in flames and substantially destroyed. It is much easier to detect and extinguish a glowing ember or small fire on the roof where it is both visible and readily accessible to firefighting efforts.

It is desirable to automatically close an attic vent whenever a sufficient increase in ambient temperature occurs beyond a threshold amount. In this situation, it is assumed that a fire, such as that caused by a wildfire or a nearby structure that may be ablaze, is what is elevating the temperature.

Warm air will begin to pass through the attic vent as the ambient temperature rises which will also warm the vent. As the fire approaches closer to the structure the danger of entry of a hot ember through an open attic vent also increases. Before this can occur, a significant temperature rise of the ambient air passing through the vent will have first occurred.

It is desirable to automatically close the vent if the temperature of a portion of the vent rises a sufficient amount so as to exceed a first threshold, thereby blocking the passage of air through the vent. It is desirable to again automatically open the vent when the temperature falls to below that of a second threshold, thereby again permitting the passage of air through the vent. The second threshold would include a temperature that is sufficiently far below the first threshold so as to ensure that no remaining fire danger existed.

While it may be possible to provide a self-destructing type of vent that effectively blocks the passage of air when the first threshold temperature amount is exceeded, such a device must be discarded and replaced if it is activated. This is both time-consuming and expensive.

The same need applies also for foundation vents that are used to vent crawl spaces under a structure or basement areas. Flammable materials are likely to be stored or found in either of these areas as well and the risk of entry of a hot ember also exists for foundation vents.

Accordingly, there exists today a need for a shape-memory spring activated soffit or foundation vent that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and are not specifically mentioned herein.

Clearly, such an apparatus would be a useful and desirable device.

2. Description of Prior Art

Vents, in general, are known. For example, the following patents describe various types of these devices, some of which may have relevance as well as others which may not have particular relevance to the invention. These patents are cited not as an admission of their having any particular relevance to the invention but rather to present a broad understanding of the current state of the art appertaining to either the field of the invention or possibly to other distal fields of invention.

U.S. Pat. No. 7,195,556 to Fichtelman, that issued on Mar. 27, 2007;

U.S. Pat. No. 5,711,091 to Bos, that issued on Jan. 27, 1998;

U.S. Pat. No. 5,393,221 to McNally, that issued on Feb. 28, 1995;

U.S. Pat. No. 5,167,578 to Legault, that issued on Dec. 1, 1992;

U.S. Pat. No. 4,848,653 to Van Becelaere, that issued on Jul. 18, 1989;

U.S. Pat. No. 4,597,324 to Spilde, that issued on Jul. 1, 1986;

U.S. Pat. No. 4,315,455 to Shaklee, that issued on Feb. 16, 1982;

U.S. Pat. No. 4,123,001 to Kolt, that issued on Oct. 31, 1978;

U.S. Pat. No. 3,232,205 to Bumstead, that issued on Feb. 1, 1966;

U.S. Pat. No. 2,755,728 to Frisby, that issued on Jul. 24, 1956; and

U.S. Pat. No. 2,718,187 to Frisby, that issued on Sep. 20, 1955 and including U.S. Patent Application Publication:

U.S. Publication No. 2007/0200656 to Walak, that published on Aug. 30, 2007.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a shape-memory spring activated soffit or foundation vent that will automatically close the vent if the ambient temperature rises to a predetermined first threshold amount.

It is also an important object of the invention to provide a shape-memory spring activated soffit or foundation vent that will retain the vent in a closed position if the ambient temperature exceeds a predetermined first threshold amount.

Another object of the invention is to provide a shape-memory spring activated soffit or foundation vent that will automatically open the vent when the ambient temperature falls below a second predetermined threshold amount.

Still another object of the invention is to provide a shape-memory spring activated soffit or foundation vent that automatically closes the vent when the temperature rises beyond a first threshold amount and which automatically opens the vent when the temperature falls below a second threshold amount.

Still yet another object of the invention is to provide a shape-memory spring activated soffit or foundation vent that can protect a home during a nearby fire by automatically closing a vent in response to an increase in ambient temperature, thereby helping to protect the house from fire by preventing the passage of burning embers through the vent and into an attic area.

Yet another important object of the invention is to provide a shape-memory spring activated soffit or foundation vent that can protect a home during a nearby fire by automatically closing a vent in response to an increase in ambient temperature, thereby helping to protect the house from fire by preventing the passage of burning embers through the vent and into a basement area.

Still yet another important object of the invention is to provide a shape-memory spring activated soffit or foundation vent that can protect a home during a nearby fire by automatically closing a vent in response to an increase in ambient temperature, thereby helping to protect the house from fire by preventing the passage of burning embers through the vent and into a crawlspace area.

A first continuing object of the invention is to provide a shape-memory spring activated soffit or foundation vent that automatically closes the vent when the temperature rises beyond a first threshold amount and which automatically opens the vent when the temperature falls below a second threshold amount and wherein the vent is reusable.

A second continuing object of the invention is to provide a shape-memory spring activated soffit or foundation vent that automatically closes the vent when the temperature rises beyond a first threshold amount and which automatically opens the vent when the temperature falls below a second threshold amount without damage to the vent, and wherein the vent will continue to provide the same or similar level of protection and utility for repeated uses, as may be needed over the course of time.

A third continuing object of the invention is to provide a shape-memory spring activated soffit or foundation vent that uses a shape-memory alloy type of spring to close the vent when a predetermined upper temperature threshold limit is exceeded.

A fourth continuing object of the invention is to provide a shape-memory spring activated soffit or foundation vent that uses a shape-memory alloy type of spring to close the vent when a first predetermined upper temperature threshold limit is exceeded and which uses a spring to open the vent when the temperature falls below a second predetermined lower temperature threshold limit.

A fifth continuing object of the invention is to provide a shape-memory spring activated soffit or foundation vent that uses a linear shape-memory alloy type of spring to close the vent when a predetermined upper temperature threshold limit is exceeded thereby providing a greater effective force for a given smaller thickness of spring and also providing a simple, cost-effective design for manufacture as well as having high-reliability and repeatability.

A sixth continuing object of the invention is to provide a shape-memory spring activated soffit or foundation vent that uses a Nitinol or a Flexinol wire type of a shape-memory alloy type of spring to close the vent when a predetermined upper temperature threshold limit is exceeded.

Briefly, a shape-memory spring activated soffit or foundation vent that is constructed in accordance with the principles of the present invention has a linear section of a shape-memory alloy type of spring that has a first expanded state with a longer length at low temperatures and a second contracted state with a shorter length at high temperatures. A counterforce type of spring urges a pivoting planar member within the vent into a normally open position when the shape-memory alloy type of spring is in the first expanded state. When the ambient temperature rises above a first temperature threshold amount the shape-memory alloy type of spring undergoes a sudden change of state and contracts from the first expanded state into the second contracted state. As the shape-memory alloy type of spring contracts it supplies a force that overcomes that of the counterforce type of spring and urges the pivoting planar member into a closed position, thereby preventing the passage of air or other objects through the vent. When the ambient temperature drops to below a second temperature threshold amount, the spring expands into the first expanded state. The counterforce type of spring then urges the pivoting planar member into the open position to again allow the passage of air through the vent.

DETAILED DESCRIPTION OF THE INVENTION

Figure 1:
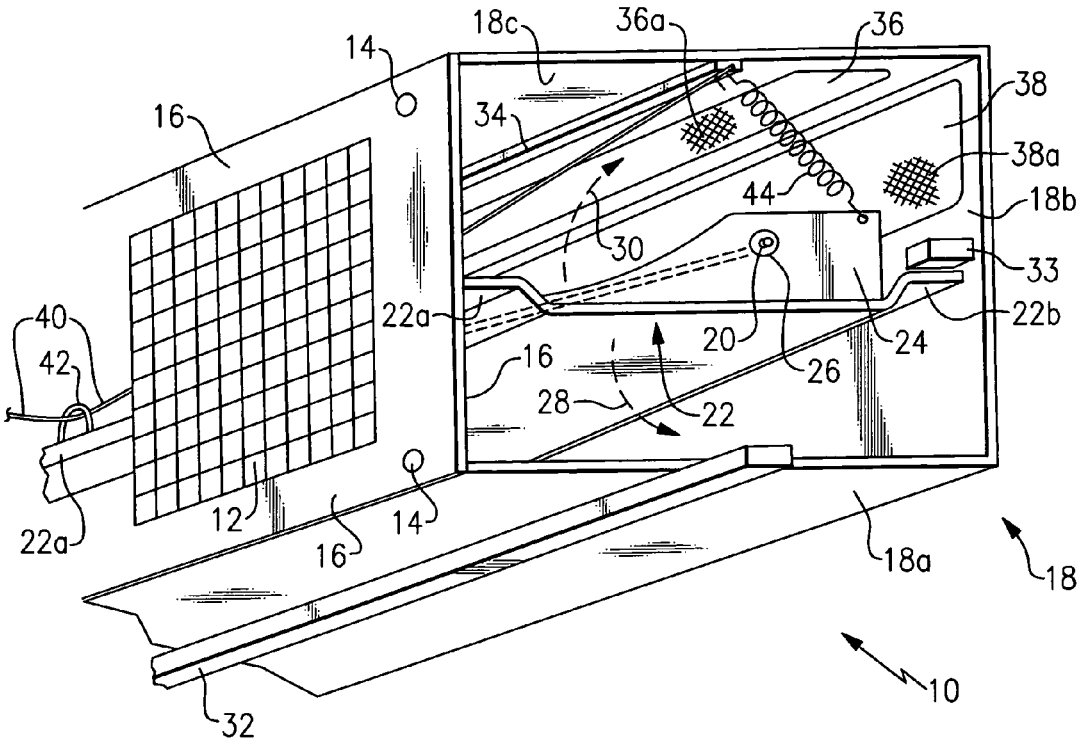
FIG. 1 is a view in perspective of an end portion of a shape-memory spring activated soffit or foundation vent.
Figure 2:
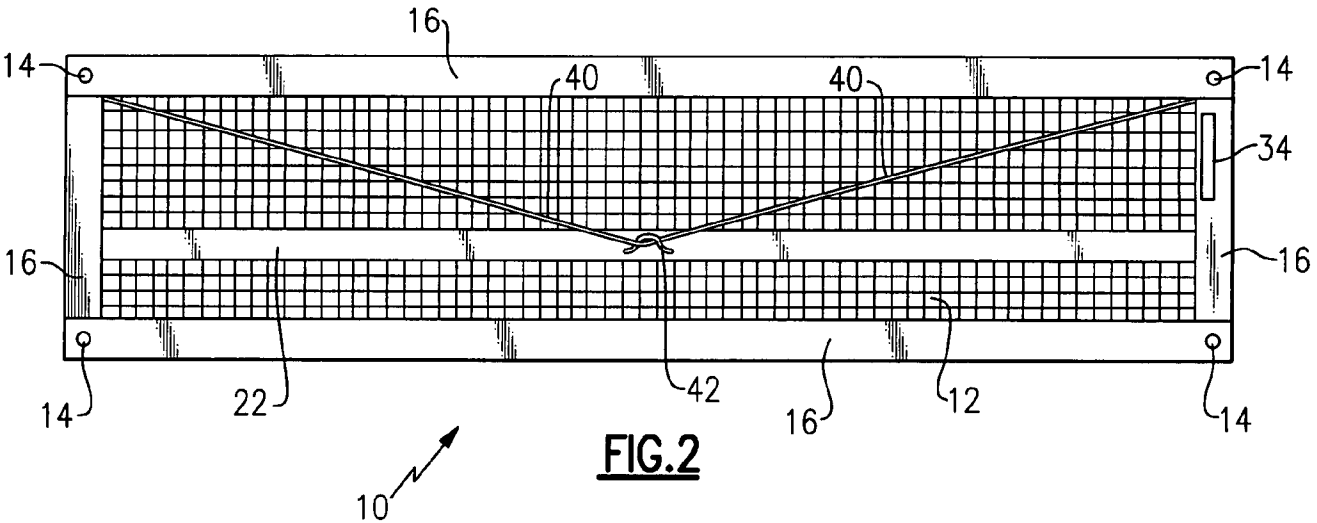
FIG. 2 is a front view of the shape-memory spring activated soffit or foundation vent of FIG. 1.
Figure 3:
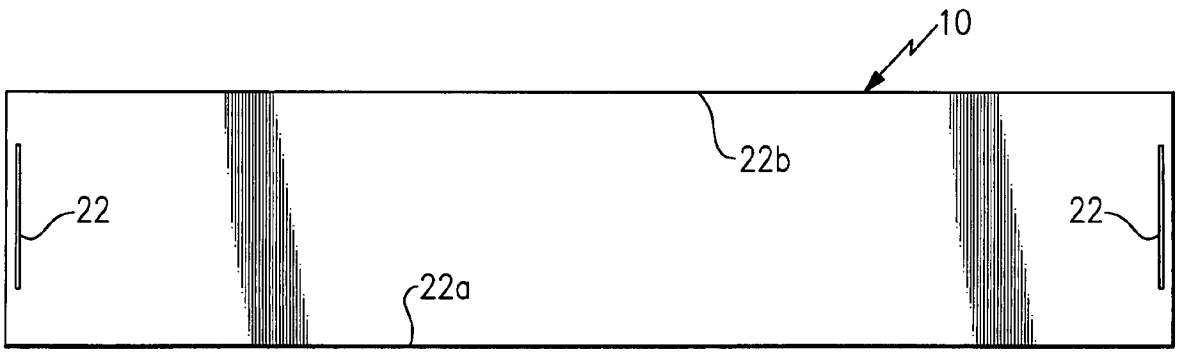
FIG. 3 is a front view of a louver of the shape-memory spring activated soffit or foundation vent of FIG. 1.

Referring to FIG. 1 and on occasion also to FIG. 2 and FIG. 3 is shown, a shape-memory spring activated soffit or foundation vent, identified in general by the reference numeral 10.

The shape-memory spring activated soffit or foundation vent 10 includes a one-quarter inch mesh 12 that faces an exterior of a structure (not shown) when the shape-memory spring activated soffit or foundation vent 10 is installed. The plane of the mesh 12 can be either horizontal or vertical, when the shape-memory spring activated soffit or foundation vent 10 is installed in a structure.

If the shape-memory spring activated soffit or foundation vent 10 is used as a soffit type of vent then it is typically installed under an eave (not shown) and the plane of the mesh 12 would be horizontal and generally in planar alignment with an underside surface of the eave. If the shape-memory spring activated soffit or foundation vent 10 is used as a foundation type of vent then it is typically installed through a concrete wall (not shown) and the plane of the mesh 12 would be vertical and generally in planar alignment with an exterior surface of the concrete.

While the shape-memory spring activated soffit or foundation vent 10 can include any preferred size, it preferably includes an overall height of 3.5 inches, a depth of 4.0 inches, and a length of 22.5 inches. These dimensions allow for easy placement between ceiling or roof joists (not shown) or between roof trusses (not shown) in eaves.

This size also allows for standard size openings to be provided through foundation (concrete) walls into which the shape-memory spring activated soffit or foundation vent 10 can be placed. If desired, the length can be shortened if sixteen inch spacing or some other spacing between joists or trusses is required.

The shape-memory spring activated soffit or foundation vent 10 is secured to the surrounding structure by any preferred fastener (not shown) that passes through fastening holes 14 provided in a mounting flange 16. The mounting flange 16 extends around the face of the shape-memory spring activated soffit or foundation vent 10 and is parallel and typically adjacent to the plane of the one-quarter inch mesh 12.

The mounting flange 16 is secured to a surrounding structure, identified in general by the reference numeral 18. The mounting flange 16 extends outward beyond the surrounding structure 18 and prevents excessive insertion of the shape-memory spring activated soffit or foundation vent 10 into the opening that is provided to receive it.

The surrounding structure 18 is typically formed of sheet metal and provides a planar bottom panel 18*a*, rear panel 18*b*, top panel 18*c* and two opposite side panels (not shown). The side panel of the shape-memory spring activated soffit or foundation vent 10 that is disposed nearest the viewer in FIG. 1 is not shown so as to provide improved clarity of view of the details of construction. Accordingly, the overall shape of the shape-memory spring activated soffit or foundation vent 10 is that of a rectangular solid with the mounting flange 16 extending outward and slightly beyond the rectangular solid shape of the surrounding structure 18.

An axle 20 extends along the longitudinal length of the shape-memory spring activated soffit or foundation vent 10 and is parallel to the plane of the mesh 12 and also parallel with respect to the bottom 18*a*, rear 18*b*, and top 18*c* side panels. The axle 20 is disposed generally close to the middle of the rear panel 18*b* (i.e., halfway between the bottom panel 18*a* and the top panel 18*c*) and is secured in place relative to the rear panel 18*b* of the surrounding structure 18 by supporting members (not shown) that are attached on one end to the axle 20 and to the rear panel 18*b* of the surrounding structure 18 at an opposite end thereof. The supporting members retain the axle 20 a predetermined distance away from the rear panel 18*b*.

A pivoting member, identified in general by the reference numeral 22, functions as a louver to regulate the passage of air through the shape-memory spring activated soffit or foundation vent 10. The pivoting member 22 includes a pair of raised sides 24 that are disposed on opposite longitudinal ends of thereof. The raised sides 24 are generally perpendicular with respect to the overall plane of the pivoting member 22.

The axle 20 passes through a pair of axle holes 26 (only one is shown) that are provided through each of the opposing raised sides 24. Accordingly, the pivoting member 22 is able to pivot about the axle 20 in a first direction as shown by arrow 28 or in an opposite second direction as shown by arrow 30.

The pivoting member 22 includes a center of gravity that extends along a longitudinal length of the pivoting member 22. The axle holes 26 and therefore the axle 20 are preferably disposed as close as possible to the center of gravity of the pivoting member 22. In this way only a minimal amount of force is required to urge the pivoting member 22 in either the first or second direction 28, 30. If the pivoting member 22 is generally symmetrical on each side of the axle 20, then the axle 20 would preferably pass near a geometric center of the pivoting member 22 to dispose the axle 20 as close as possible to the center of gravity of the pivoting member 22.

During normal use of the shape-memory spring activated soffit or foundation vent 10, the pivoting member 22 will continue to pivot in the first direction as shown by arrow 28 until a rear lip 22*b* of the pivoting member 22 is disposed against a rear stop 33. The rear stop 33 is attached to the rear panel 18*b* and protrudes therefrom an amount sufficient to make contact with the rear lip 22*b* and thereby prevents further motion of the pivoting member 22 in the direction of arrow 28.

The rear lip 22*b* of the pivoting member 22 extends along an opposite side where a lip 22*a* is disposed. The lip 22*a* is disposed on a side of the pivoting member 22 (i.e., on a first side of the axle 20) that is closest to the mesh 12 and the rear lip 22*b* is disposed on an opposite side of the pivoting member 22 with respect to the axle 20.

The lip 22*a* and the rear lip 22*b* each provide a counter weight to help balance the pivoting member 22 and ensure that the center of gravity of the pivoting member 22 is disposed where the axle 20 is located.

The position of the pivoting member 22 as shown in FIG. 1 is the first, open position of the shape-memory spring activated soffit or foundation vent 10 and is the position that the shape-memory spring activated soffit or foundation vent 10 is normally disposed in when performing its normal function as a vent. In this position the plane of the pivoting member 22 (i.e., louver) is generally perpendicular with respect to the plane of the mesh 12 or of the rear panel 18*b*.

Air is able to pass by the pivoting member 22 virtually unobstructed and to continue through the shape-memory spring activated soffit or foundation vent 10. Ambient air normally begins to vent either an attic area or a foundation basement or crawl space area by entering the mesh 12 and exiting from locations to the rear of the shape-memory spring activated soffit or foundation vent 10, as are described in greater detail hereinafter.

Preferably, the raised sides 24 (which are disposed along the distal ends of the pivoting member 22) are adjacent to the side panels of the surrounding structure 18 with only a minimal clearance amount therebetween. The space between the outside edge of the raised sides 24 and the distal ends (i.e., where the raised sides 24 are located) of the pivoting member 22 is too small to permit objects, such as embers or even smaller ember fragments, to pass. Accordingly, only a negligible amount of air is able to flow around the distal ends of the pivoting member 22 at all times.

When the shape-memory spring activated soffit or foundation vent 10 is disposed in the first or open position it permits the normal passage of air to occur there-through. In the first open position a lip 22*a* of the pivoting member is disposed proximate the middle of the mesh 12 (inside the surrounding structure 18) and the lip 22*a* extends across the length of the shape-memory spring activated soffit or foundation vent 10, as shown in FIG. 1. The means to urge the pivoting member 22 into the first or open position are discussed in greater detail hereinafter.

However, in the event of a nearby fire that raises ambient temperatures a sufficient amount the pivoting member 22 will be urged and will pivot in the opposite, second direction as shown by arrow 30. The pivoting member 22 will continue to pivot in the direction of arrow 30 until the lip 22*a* of the pivoting member 22 is disposed against an upper stop 34. The upper stop 34 extends along the longitudinal length and is generally equal to the length of the lip 22*a*.

At the same time that the lip 22*a* makes contact with the upper stop 34, the rear lip 22*b* makes contact with a lower stop 32.

When the lip 22*a* is disposed against the upper stop 34 and the rear lip 22*b* is disposed against the lower stop 32, the shape-memory spring activated soffit or foundation vent 10 is disposed in the second or closed position and this position prevents the passage of any significant amount of air from occurring there-through.

The lower stop 32 and the upper stop 34, when either is in contact with the lip 22*a*, provide an effective seal that prevents the passage of any appreciable amount of air (or objects of any size) from occurring in the space that is disposed between the lip 22*a* and the upper stop 34 and also in the space that is disposed between the rear lip 22*b* and the lower stop 32.

For the purpose of improving clarity of description, the pivoting member 22, as shown in FIG. 1 is disposed in the middle of the mesh 12 in the first or open position. This position is a static or rest position in which the pivoting member 22 is almost always disposed unless an elevated ambient temperature condition exists, as is described in greater detail hereinafter.

The only other static or rest position possible for the pivoting member 22 is in the second, or closed position. Except for the briefest time duration (typically milliseconds) during which the pivoting member 22 will be transitioning either from the open position into the closed position or from the closed position into the open position, the pivoting member 22 will be disposed in one of the two static or rest positions, depending on which direction it is heading (either in the direction of arrow 28 until the pivoting member 22 is disposed in the open position or in the direction of arrow 30 until it is disposed in the closed position). In other words, any position between the first open position and the second closed position is not a static or rest position for the pivoting member 22.

As previously mentioned, the normal (venting) position for the pivoting member 22 is in the open position with the rear lip 22*b* in contact with the rear stop 33 and with the lip 22*a* disposed near the middle of mesh 12. This is the position that the shape-memory spring activated soffit or foundation vent 10 will almost always be in and which allows for the normal passage of air to occur.

When the pivoting member 22 is disposed in the first, open position a significant and appreciable amount of air is able to pass readily through the shape-memory spring activated soffit or foundation vent 10 and when it is disposed in the second, closed position the significant and appreciable amount of air is not able to pass through the shape-memory spring activated soffit or foundation vent 10 because its passage is obstructed by the positioning of the pivoting member 22 and by the seal provided by contact with the upper stop 34 and by contact with the lower stop 32.

It is useful to note that while it is desirable to stop entirely the passage of air when the pivoting member 22 is disposed in the second, closed position it is still acceptable if a very small negligible amount of air to continues to flow through the shape-memory spring activated soffit or foundation vent 10.

The amount of air that is deemed to be negligible can vary depending on industry standards and the application. The design of the shape-memory spring activated soffit or foundation vent 10 is varied to satisfy the required standards, for example, by design changes in the material that is used to form the upper and lower stops 34, 32. A more elastic material can provide a better seal. Similarly, the clearance between the ends of the pivoting member 22 and the side panels of the surrounding structure 18 can be varied or, if desired, material can be added to the side panels or to the ends of the pivoting member 22 to provide better seal capability.

When the pivoting member 22 is disposed in the second closed position with the lip 22*a* adjacent to and in contact with the upper stop 34 and the rear lip 22*b* also disposed against the lower stop 32, it ensures that air cannot flow to the rear of the shape-memory spring activated soffit or foundation vent 10 to any location that is disposed beyond (i.e., behind) a plane that is defined by the lower stop 32, the pivoting member 22, and the upper stop 34.

Conversely, when the pivoting member 22 is disposed in the first or open position air is able to easily flow to the rear of the shape-memory spring activated soffit or foundation vent 10 to any location that is disposed beyond (i.e., behind) the plane that is defined by the lower stop 32, the pivoting member 22, and the upper stop 34.

Therefore, it is possible to locate one or more exit paths for air to exit from the shape-memory spring activated soffit or foundation vent 10 providing that they are disposed behind the plane that is defined by the lower stop 32, the pivoting member 22, and the upper stop 34.

To illustrate flexibility in the location of possible air exit paths for the shape-memory spring activated soffit or foundation vent 10 a large first opening 36 is provided in the top panel 18*c* between the upper stop 34 and the rear panel 18*b*. Also, a large second opening 38 is provided in the rear panel 18*b*. The second opening 38 in the rear panel 18*b* can be larger than shown with a maximum opening size that is almost as large as the rear panel 18*b*, if desired.

A first opening ember screen 36*a* and a second opening ember screen 38*a* are included and extend over the area that is provided by the first opening 36 and the second opening 38, respectively. Only a portion of the first opening ember screen 36*a* and the second opening ember screen 38*a* are shown in the first and second openings 36, 38.

The first opening ember screen 36*a* and the second opening ember screen 38*a* are preferably made of stainless steel and include a preferred hole diameter of approximately 0.011 inches, which is small enough to prevent even small embers from passing through the shape-memory spring activated soffit or foundation vent 10 before a rise in temperature has occurred that is sufficient to cause activation of the shape-memory spring activated soffit or foundation vent 10.

Otherwise, it is possible when during the approach of a fire, that small embers could be carried by convective air currents and that the embers might reach the shape-memory spring activated soffit or foundation vent 10 before a noticeable increase in ambient temperature occurred. It is important to ensure that such embers are blocked and not allowed to pass through the shape-memory spring activated soffit or foundation vent 10. The first opening ember screen 36*a* and the second opening ember screen 38*a* prevent the passage of embers from occurring.

Activation of the shape-memory spring activated soffit or foundation vent 10 is discussed in greater detail hereinafter. The preferred hole diameter for the first opening ember screen 36*a* and the second opening ember screen 38*a* provides an effective barrier to embers while not excessively decrease airflow through the shape-memory spring activated soffit or foundation vent 10.

An example of a possible material that can be used for either the first opening ember screen 36*a* or the second opening ember screen 38*a* is supplied by TWP of Berkeley and is classified in their product literature as, "Eight (8) Mesh Galvanized Hardware Cloth, 0.013 Wire Diameter, 36 Inches Wide Screen, 31 Gauge, ⅛ Mesh".

In this manner, the shape-memory spring activated soffit or foundation vent 10 can provide venting at a right angle with respect to the plane of the mesh 12 or it can provide venting that is parallel to the plane of the mesh 12 and at an opposite end (i.e. to the rear) of the shape-memory spring activated soffit or foundation vent 10 as compared to where the mesh 12 is disposed. Right angle or upward venting may be desirable in certain types of installations whereas rear venting is desirable in many other types of installation. If desired, both the first opening 36 and the second opening 38 can be included or either the first opening 36 or the second opening 38 can be eliminated, depending on the intended use for any particular version of the shape-memory spring activated soffit or foundation vent 10.

A shape-memory alloy spring 40 is provided that is attached to the top panel 18*c* near the upper stop 34 at a first end 40*a* of the shape-memory allow spring 40. The shape-memory alloy spring 40 is preferably of linear construction, as shown, and it extends from the above described point of attachment in a generally downward and inward direction to a center of the lip 22*a* of the pivoting member 22 to which it is secured in any preferred manner. The shape-memory alloy spring 40, as shown, passes through an opening provided in a loop 42. The loop 42 is attached at both ends thereof to an upper surface of the lip 22*a*. In this way, any force that is applied to the loop 42 to urge it in the direction of arrow 30 will also urge the pivoting member 22 in that direction, as well.

The shape-memory alloy spring 40 continues past the loop 42 and in a direction that is generally outward and also upward toward an opposite end of the upper stop 34, where an opposite end of the shape-memory alloy spring 40 is attached.

A counterforce spring 44 is also attached at a first end thereof proximate the upper stop 34 and, at an opposite end of the counterforce spring 44, to a rear portion of the raised side 24. If desired, a second identical counter force spring (not shown) is provided and is attached in like manner to the opposite side of the pivoting member 22 and to the opposite side of the upper stop 34 to provide either greater or a more balanced counterforce to the pivoting member 22.

After the shape-memory spring activated soffit or foundation vent 10 has been installed in an eave (as a soffit vent) or in a foundation opening (as a foundation vent) for as long as the ambient temperature remains below a first predetermined upper temperature threshold limit the pivoting member 22 will be disposed in the first, open position and the passage of air will be permitted to occur normally through the shape-memory spring activated soffit or foundation vent 10.

In this, the first or open position, the shape-memory alloy spring 40 is disposed in a first or extended state. Because this is the normal position for the pivoting member 22 it can also be regarded as a quiescent state for the shape-memory spring activated soffit or foundation vent 10 to be disposed.

Accordingly, when the pivoting member 22 is in the first or open position the shape-memory alloy spring 40 is in the extended state (i.e., its linear length is at a maximum amount) and it therefore does not supply any appreciable force to the pivoting member 22. In the first or quiescent state, the counterforce spring 44 supplies a force that raises the portion of the pivoting member 22 that is disposed to the rear of the axle 20 in a generally upward direction and which urges the lip 22*a* in a generally downward direction, thereby causing the pivoting member 22 to move in the direction of arrow 28 until the rear lip 22*b* comes into contact with the rear stop 33.

It is important to understand that as long as the shape-memory alloy spring 40 is in the extended state it will provide no force to oppose the force that is supplied to the pivoting member 22 by the counterforce spring 44. Therefore, when the shape-memory alloy spring 40 is in the extended state, the pivoting member 22 will always be disposed as shown in FIG. 1 (in the first or open position) and air will able to vent through the device.

If a fire is nearby the ambient temperature will begin to rise in proportion to the intensity of the blaze and its approach to the structure. As the ambient temperature rises the shape-memory spring activated soffit or foundation vent 10 is also warmed accordingly. The normal venting of ambient air through the shape-memory spring activated soffit or foundation vent 10 quickly raises its temperature as well. Furthermore, because the shape-memory alloy spring 40 of the shape-memory spring activated soffit or foundation vent 10 is formed of metal it conducts heat especially well and will quickly rise in temperature in response to the ambient temperature rising.

When the ambient temperature rises above the first predetermined upper temperature threshold limit the shape-memory allow spring 40 is warmed by the passing air until it, too, has reached or exceeded the first predetermined upper temperature threshold. At this moment, the shape-memory alloy spring 40 will suddenly change its state from the first extended state and, according to the mechanical properties inherent in its design, it will quickly revert or spring back into a second contracted state. Unless a sufficient force prevents it from contracting fully into the second contracted state it will very quickly (typically within milliseconds) revert back into (or close to) the second contracted state. In the second contracted state the overall linear length of the shape-memory alloy spring 40 will decrease considerably from what it was when the shape-memory alloy spring 40 was in the extended state.

When in the contracted state, the shorter overall length of the shape-memory alloy spring 40 is not sufficient to permit the pivoting member 22 to remain in the first or open position. The shorter length of the shape-memory alloy spring 40 will supply a force to the loop 42 sufficient to overcome the force of the counterforce spring 44 and to urge both the loop 42 and the lip 22*a* in the direction of arrow 30 until the lip 22*a* is in contact with the upper stop 34 and the rear lip 22*b* is in contact with the lower stop 32. The shorter contracted length of the shape-memory alloy spring 40 is chosen to ensure that even when the pivoting member 22 is disposed in the second position at least some residual force greater than that supplied by the counterforce spring 44 will be provided by the shape-memory alloy spring 40 sufficient to retain the pivoting member 22 in the second or closed position. Because the shape-memory alloy spring 40 has only two states (extended or contracted) the transition of the pivoting member 22 from one state to another (open to closed or closed to open) will always occur quickly, requiring only milliseconds to complete for most versions of the shape-memory spring activated soffit or foundation vent 10.

At this time the shape-memory spring activated soffit or foundation vent 10 will be closed and the venting of air will cease. Hot embers will be prevented from passing through the shape-memory spring activated soffit or foundation vent 10.

The shape-memory alloy spring 40, and therefore the shape-memory spring activated soffit or foundation vent 10, will remain in the second, closed position until the ambient temperature falls below a second predetermined lower temperature threshold limit. The second predetermined lower temperature threshold limit includes a temperature that is lower than that of the first predetermined upper temperature threshold limit.

In other words, even after the ambient temperature has cooled to a level that is just below the temperature which caused the shape-memory spring activated soffit or foundation vent 10 to enter the second or closed state (i.e., below that of the first predetermined upper temperature threshold limit), it will not automatically revert back into the first or open state. It must cool an even greater amount in order to reach the second predetermined lower temperature threshold limit. At that time (i.e., as soon as the shape-memory alloy spring 40 has also been cooled to the second predetermined lower temperature threshold) the shape-memory alloy spring 40 will again suddenly revert back into its first or extended state.

It is a characteristic for shape-memory alloy springs, in general, to exhibit two distinct physical (mechanical) states where the transition from each state into the other state is temperature activated and in which a first state includes a more extended mechanical configuration and thereby the first state provides for a lower level of force (as a spring) and in which a second state includes a more contracted mechanical configuration and thereby the second state provides a higher level of force (as a spring).

Continuing with a general discussion about shape-memory alloy springs, the second contracted state is activated instantly whenever the temperature rises above the first predetermined upper temperature threshold limit, whereas the first extended state requires the temperature of the shape-memory alloy spring to fall below that of the first predetermined upper temperature threshold limit and to continue to descend even further until reaching the second predetermined lower temperature threshold limit, at which time activation of the shape-memory alloy spring will cause it to assume the first extended state. The shape-memory alloy spring 40 of the instant invention also functions in this way.

When the shape-memory alloy spring 40 has also been cooled to or below the second predetermined lower temperature threshold it will revert into the first extended state and being extended it will no longer exert a force upon the pivoting member 22. The only force acting on the pivoting member 22 will be that as is supplied by the counterforce spring 44 which will quickly urge the pivoting member 22 to pivot about the axle 20 in the direction of arrow 28 and to enter into the first, open position. Typically, the pivoting member 22 will return from the second closed position into the first open position in a matter of milliseconds. Normal venting through the shape-memory spring activated soffit or foundation vent 10 will again resume.

The above closing and opening of the shape-memory spring activated soffit or foundation vent 10 can recur many times, if needed. While it is unlikely that many repeat cycles will occur, it is advantageous that the shape-memory spring activated soffit or foundation vent 10 be able to repeat its ability to automatically function in the manner previously described because this capability eliminates any need to remove the shape-memory spring activated soffit or foundation vent 10 after it has been triggered (i.e., after it has been closed) by a high temperature event and to replace it with a new device. This saves the cost of a new device as well as that of the labor to remove the old one and install a new shape-memory spring activated soffit or foundation vent 10.

The difference in temperature between the first predetermined upper temperature threshold and the second predetermined lower temperature threshold is equal to that of the hysteresis of the shape-memory alloy spring 40, and is a design variable, as is the preferred temperature for the first predetermined upper temperature threshold and for the second predetermined lower temperature threshold.

A preferred value for the first predetermined upper temperature threshold is 225 degrees Fahrenheit and a preferred value for the second predetermined lower temperature threshold is 125 degrees Fahrenheit. These temperatures can vary as desired, and are set into the shape-memory alloy spring 40 during its manufacture. Certain of the characteristics of the shape-memory alloy spring 40 are dependent upon the alloy that is used for its construction while other characteristics can be set during its manufacture. Shape-memory alloy springs generally undergo a type of conditioning during manufacture which sets their characteristics prior to usage, as is well known by those having skill in the art of designing and manufacturing shape-memory alloy types of springs 40.

It is also possible to include a very low hysteresis value for the shape-memory alloy spring 40. For some alloys the hysteresis value may be negligible or it can approach zero. If such a version of the shape-memory alloy spring 40 is used, for ambient temperatures in excess of the first predetermined upper temperature threshold the pivoting member 22 will be in the closed position while for ambient temperatures that are below the first predetermined upper temperature threshold the pivoting member 22 will be in the open position.

If the shape-memory alloy spring 40 includes a very low (or negligible) amount of hysteresis and if the shape-memory spring activated soffit or foundation vent 10 is exposed to a sustained ambient temperature that is approximately equal to the first predetermined upper temperature threshold, then the pivoting member 22 may be disposed in either the open or the closed position, or it may alternate between the two positions.

Generally, it is preferable to include at least some hysteresis for smoother operation and to ensure that the pivoting member 22 remains closed after activation until the ambient temperature has cooled a sufficient amount to prevent excessive heat from passing through the shape-memory spring activated soffit or foundation vent 10, and possibly entering the structure. It is also important to note that any preferred value for the first predetermined upper temperature threshold or for the second predetermined lower temperature threshold are possible, and may vary in accordance with the design parameters and requirements for any given installation.

Accordingly, many variables of design are possible. For example, the shape-memory alloy spring 40 does not have to be linear. A coiled version (not shown) is also possible for use with modification to the design. However, the linear version provides for increased strength of pull (i.e., the force generated when it contracts) while using a thinner, less expensive material than may be available with the coiled version. Also, ease of assembly and therefore of manufacturing at low cost is also provided by the linear version along with a simplicity of design that contributes to long life, high reliability, and repeatability of functioning.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A shape-memory spring activated soffit or foundation vent, comprising:

(a) an enclosure;

(b) a pivoting member disposed in said enclosure, wherein said pivoting member is supported by and able to pivot about an axis into a first, open position which allows for the passage of a sufficient volume of air to occur through said vent or into a second, closed position which prevents the passage of said sufficient volume of air from occurring through said vent;

(c) a shape-memory alloy spring that includes a first expanded state and a second contracted state and wherein said shape-memory alloy spring is attached to said enclosure and to said pivoting member, and wherein said shape-memory alloy spring is able to urge said pivoting member into said second closed position when an ambient temperature reaches or exceeds a first predetermined upper temperature threshold; and (d) means for urging said pivoting member into said first, open position when said shape-memory allow spring is not disposed in said second contracted state;

and wherein said shape-memory spring activated soffit or foundation vent substantially prevents the flow of ambient air there-through when said ambient temperature reaches or rises above said first predetermined upper temperature threshold, and wherein said shape-memory spring activated soffit or foundation vent permits the flow of ambient air there-through when said ambient temperature reaches or falls below a second predetermined lower temperature threshold.

2. The shape-memory spring activated soffit or foundation vent of claim 1 wherein subsequent to a rise in temperature of said shape-memory alloy spring above said first predetermined upper temperature threshold said shape-memory alloy spring contracts into said second contracted state, and wherein subsequent to a drop in temperature of said shape-memory alloy spring below said second predetermined lower temperature threshold said shape-memory alloy spring expands into said first expanded state.

3. The shape-memory spring activated soffit or foundation vent of claim 2 wherein said first predetermined upper temperature threshold is 225 degrees Fahrenheit and said second predetermined lower temperature threshold is 125 degrees Fahrenheit.

4. The shape-memory spring activated soffit or foundation vent of claim 3 wherein a difference in temperature between said first predetermined upper temperature threshold and said second predetermined lower temperature threshold includes a hysteresis of said shape-memory spring.

5. The shape-memory spring activated soffit or foundation vent of claim 1 wherein said shape-memory alloy spring includes a linear shape.

6. The shape-memory spring activated soffit or foundation vent of claim 5 wherein a first end of said shape-memory alloy spring is attached to said enclosure and an opposite second end of said shape-memory alloy spring is attached to said enclosure, and wherein a portion of said shape-memory alloy spring that is intermediate said first end and said second end thereof is cooperatively engaged with said pivoting member, and wherein when said shape-memory alloy spring contracts into said contracted state, it supplies a force to urge said pivoting member into said second closed position.

7. The shape-memory spring activated soffit or foundation vent of claim 1 wherein said means for urging said pivoting member into said first, open position includes a counterforce spring, and wherein said counterforce spring supplies a force sufficient to urge said pivoting member into said first open position when said shape-memory alloy spring is not disposed in said second contracted state.

8. The shape-memory spring activated soffit or foundation vent of claim 1 including an axle and wherein said axle includes said axis.

9. The shape-memory spring activated soffit or foundation vent of claim 8 wherein said axle is disposed proximate a longitudinal center of gravity of said pivoting member.

10. The shape-memory spring activated soffit or foundation vent of claim 1 including at least one stop that is attached to said enclosure, and wherein said at least one stop limits an amount said pivoting member can pivot about said axis.

11. The shape-memory spring activated soffit or foundation vent of claim 10 wherein said at least one stop provides a seal to limit the passage of air past said pivoting member.

12. The shape-memory spring activated soffit or foundation vent of claim 1 wherein said enclosure includes a surrounding structure, and wherein said surrounding structure includes a bottom panel, a rear panel, a top panel and two side panels that, together, include a generally rectangular-solid overall shape.

13. A method for closing a soffit or foundation vent during a rise in ambient temperature above a first predetermined upper temperature threshold, comprised of the steps of:

(a) providing a shape-memory spring activated soffit or foundation vent, comprising:

(1) an enclosure;

(2) a pivoting member disposed in said enclosure, wherein said pivoting member is supported by and able to pivot about an axis into a first, open position which allows for the passage of a sufficient volume of air to occur through said vent or into a second, closed position which prevents the passage of said sufficient volume of air from occurring through said vent;

(3) a shape-memory alloy spring that includes a first expanded state and a second contracted state and wherein said shape-memory alloy spring is attached to said enclosure and to said pivoting member, and wherein said shape-memory alloy spring is able to urge said pivoting member into said second, closed position when said ambient temperature reaches or exceeds said first predetermined upper temperature threshold; and (4) means for urging said pivoting member into said first, open position when said shape-memory alloy spring is not disposed in said second contracted state; and (b) elevating said temperature above said first predetermined upper temperature threshold; and wherein said shape-memory spring activated soffit or foundation vent substantially prevents the flow of ambient air there-through when said ambient temperature reaches or rises above said first predetermined upper temperature threshold, and wherein said shape-memory spring activated soffit or foundation vent permits the flow of ambient air there-through when said ambient temperature reaches or falls below a second predetermined lower temperature threshold.

* * * * *